US005347687A

United States Patent [19]

Lautenschläger

[11] Patent Number: 5,347,687

[45] Date of Patent: Sep. 20, 1994

[54] HINGE HOUSING

[75] Inventor: Gerhard W. Lautenschläger, Brensbach, Fed. Rep. of Germany

[73] Assignee: Mepla-Werke Lautenschlager GmbH & Co. KG, Reinheim, Fed. Rep. of Germany

[21] Appl. No.: 985,593

[22] Filed: Dec. 3, 1992

[30] Foreign Application Priority Data

Dec. 24, 1991 [DE] Fed. Rep. of Germany ..... 4142988

[51] Int. Cl.[5] ..... E05D 5/00

[52] U.S. Cl. ..... 16/382; 16/DIG. 43

[58] Field of Search ..... 16/382, DIG. 43, 272, 16/257

[56] References Cited

U.S. PATENT DOCUMENTS 5,195,214 3/1993 Lautenschlager et al. ..... 16/382

FOREIGN PATENT DOCUMENTS 7238739 10/1972 Fed. Rep. of Germany .
2143672 3/1973 Fed. Rep. of Germany .
2606181 12/1983 Fed. Rep. of Germany .
2636767 7/1987 Fed. Rep. of Germany .
3722950 1/1989 Fed. Rep. of Germany ..... 16/382
4037752 7/1992 Fed. Rep. of Germany .

*Primary Examiner*—Carmine Cuda

[57] ABSTRACT

A hinge housing for installation in an opening in a thin sheet wall of a door is provided. The hinge housing has a liner plate for installation along an underside thereof against an inside face of the wall, the liner plate having an opening which generally conforms to the opening in the wall, the liner plate having at least two first locking projections extending from the underside of the plate which can grip an outside face of the wall upon rotation of the lining plate. The hinge housing also has a fastening flange for installation against the upper side of the liner plate, the fastening flange having a cup portion and a flange portion extending radially from a rim of the cup portion, the outside perimeter of the cup portion generally conforming to the opening in the wall, such that when the fastening flange is installed against the liner plate, the flange portion covers the liner plate and the cup portion extends into the opening and through the wall. The fastening flange also has at least two second locking projections extending from the underside of the flange portion, the second locking projections corresponding in number and arrangement with the first locking projections, the second locking projections being engageable with the first locking projections upon rotation of the fastening flange to forcibly retain the first locking projections against the outside face of the wall.

17 Claims, 3 Drawing Sheets

HINGE HOUSING

Figure 1:
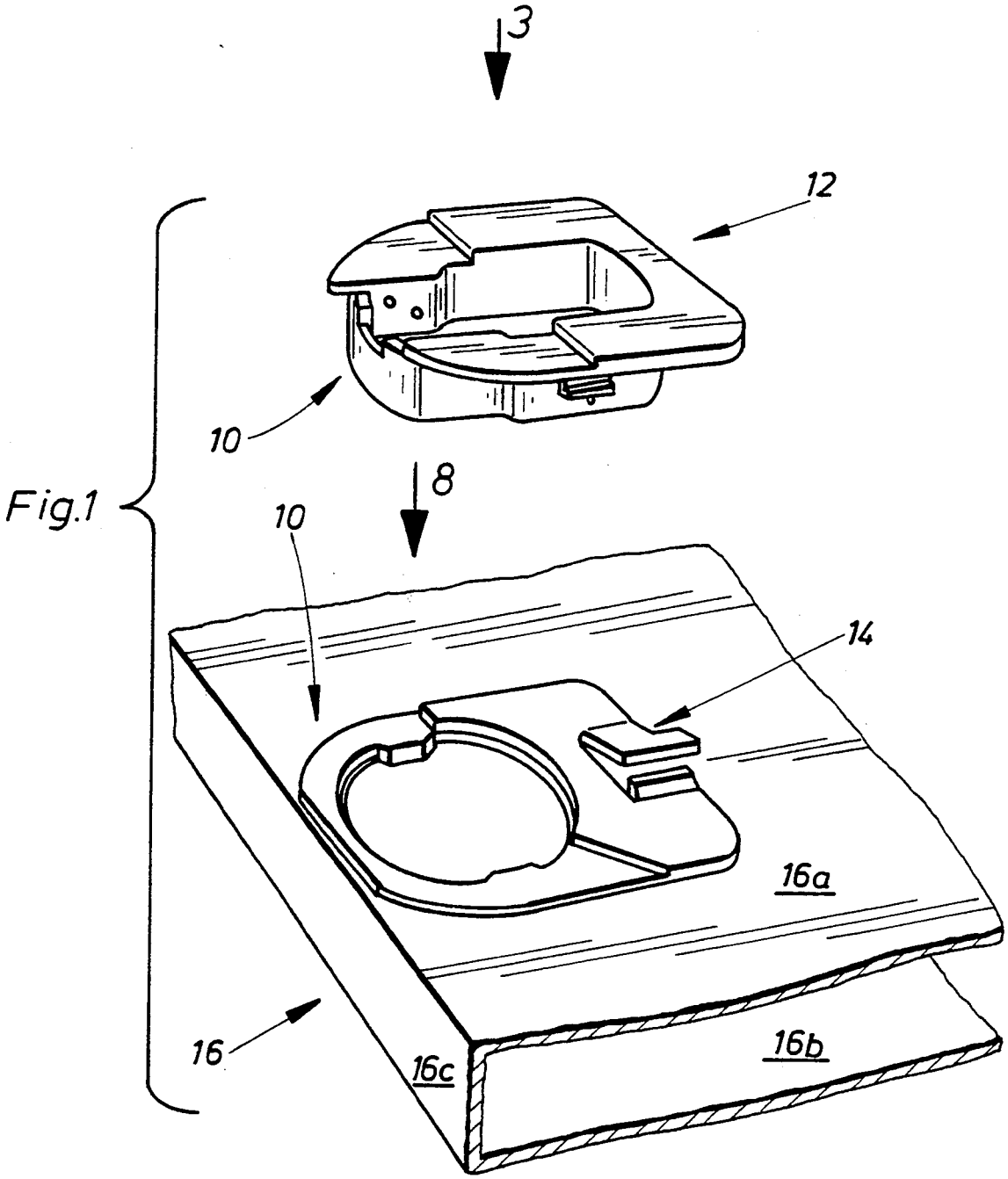

The invention relates to a hinge housing in the form of a fastening flange having a metal cup which can be recessed in an opening in the back of a cabinet door consisting of at least one wall of thin sheet metal, the cup having a flange portion extending integrally and radially from its rim over the margin of the opening in the door when the hinge housing is installed on the door in the intended position. The edges of the flange are rolled toward the door, so that a shallow recess facing the inside of the door is formed in the bottom of the flange. The housing has a liner plate, preferably of plastic, disposed between the fastening flange and the inside of the door, which can be releasably joined to the hinge housing by a locking device which can be brought into or out of engagement by turning the cup relative to the liner plate by a given angular amount about an axis of rotation at right angles to the inside edge of the door.

The configuration in this form, namely hinge housing for modern multi-jointed cabinet hinges serving as door-related hinge parts which can be sunk in a mortise on the inside of a cabinet door made of wood material, i.e., in the form of a hinge housing composed of a cup portion made of metal with a fastening flange, plus a liner of plastic which is virtually invisible after fastening on and in the door, has become increasingly popular in recent years, in comparison with the hinge housings of plastic which were formerly most widely used. The metal part, made either by stamping from sheet metal or by pressure casting from a metal alloy, on the one hand determines the appearance of the hinge housing and on the other hand provides the necessary great ability to withstand stress, while the plastic liner which in the installed state is invisible or nearly invisible provides for the precise alignment of the metal part in the mortise in the door. The hinge housing is fastened to the door by one or two screws passing through countersunk bores in the fastening flange of the metal part and through holes in the underlying part of the plastic liner and driven either directly into the door, or by screws driven into fastening studs provided on the liner, which in turn are held in holes drilled into the wood material of the door at a distance from the mortise provided for the cup part. These fastening studs made integral by injection molding with the liner are made oversize with respect to the inside diameter of the fastening bores in the door, so that they tightly fasten the installed hinge housing to the door. By configuring the fastening studs in the manner of expansion plugs which can be spread apart by the fastening screws, the tight seating of the hinge housing on and in the door can be further improved. The hinge housing can be removed from the door, however, by unscrewing the fastening screw(s), since then the metal part is unfastened from the liner. This screwing procedure is labor intensive and, if the metal part is repeatedly removed from and refastened to the liner the threads of the screws in the fastening studs, or, where the latter are lacking, in the walls of the fastening bores in the door, wear out, so that the tight seating and secure mounting of the hinge housing on the door deteriorates. As an example of the known hinge housing see the hammer-in housing disclosed in German Patents 26 06 181 and 26 36 767.

In addition to furniture made of wood material, furniture made of sheet metal is increasingly been manufactured in recent times for special purposes, such as furniture for the office, in which the doors are often double-walled for aesthetic reasons and to improve rigidity. Hinges with the known hinge housings designed for fastening to wooden doors cannot be used on such metal doors.

The invention is accordingly addressed to the problem of improving the known hinge housings such that they will also be usable for hanging doors made of thin sheet metal on the carcase of a corresponding cabinet, permitting simple and speedly installation of the hinge housing on the door and its removal therefrom.

Setting out from a hinge housing of the kind described above, this problem is solved in accordance with the invention in that the opening in the wall of the door is punched in a shape that is circular at least on most of its circumference, that the liner plate lying on the inner side of the carcase-interior wall of the door and concealed by the fastening flange reaches, at at least two points offset circumferentially from one another, through the boundary of the punched opening and has projections caught on the outer side of the wall, i.e., the side facing away from the carcase, and that, at a distance below the fastening flange a number of locking projections extend radially from the cup part, corresponding to the number and arrangement of the projections of the liner, which can be passed through the opening in the door and liner in a position rotated relative to the intended installed position of the cup part in the door, and can be brought by rotation into the intended installed position in catching engagement below the radial projections of the liner plate.

The cut-out in the wall of the door has on two diametrically opposite sides a rectilinear section at right angles to the adjacent edge of the door, the distance between these sections being less than the diameter of the remaining arcuately shaped sections of the cut-out, and then the cup part is flattened laterally in its areas opposite the rectilinear sections of the cut-out when in its proper installed position, and it has a catch projection in each of the laterally flattened areas. For installation, the hinge housing is then applied in a rotated position such that the catch projections extending from the cup part are passed through the arcuately defined sections and then, after the cup part has been turned to the intended installation position, they are locked under the wall areas adjoining the rectilinear sections.

The radial projections of the liner plate are then also guided through the cut-out in the area of the rectilinear sections, so that the catch projections, when in the intended installed position, are locked to the door wall not directly but by the radial projections of the liner plate. Thus the cup part and the liner plate are simultaneously fixed in the proper installed position.

An additional fixation of the liner plate is best obtained by providing, in the area of the wall that is below the fastening flange in the proper installed position, at least one additional cut-out of lesser diameter at a distance from the cut-out accommodating the cup part of the hinge housing, and by providing the liner plate with fastening pins which can be fitted into the associated cut-out in the area or areas lying above the additional cut-out or cut-outs. These fastening pins constitute an additional means of preventing the liner plate from turning. By making them oversize with respect to the diameter of the additional cut-outs, they can be held by constriction against withdrawal.

Instead of holding the fastening pins by constructive force, however, a positive fixation in the associated additional cut-out can be achieved if the fastening pin or pins have each at least one resilient catch projection which catches on the flat side opposite the inside of the door wall in the proper installed position, and which is forced back by the associated cut-out when the fastening pin is inserted and then snaps out again in back of the opposite flat side.

The surfaces of the radial projections of the liner plate which lie against one another in the proper installed position, and the catch projections of the cup part, are configured slantingly with respect to the wall of the door in a complementary manner such that, upon the rotation of the cup part from the insertion position into the proper installed position a tension drawing the catch projections and the radial projections against the door wall is produced.

In an advantageous further development of the invention the liner plate has at least one tongue projecting outward partially above the margin of the fastening flange, which can be flexed at right angles to the inside face of the door wall and guided resiliently at its free end to a position raised away from the inside surface, with which there is associated a projection extending from the wall-facing bottom of the fastening flange and catching in the proper installed position on the free end of the tongue and preventing any turning back to the insertion position. It is then desirable to provide on the liner plate an abutment cooperating with the projection extending from the bottom of the fastening flange to prevent the cup part from turning beyond the proper installed position.

The tongue locking the hinge housing in the proper installed position is best an integral part of the liner plate cut from the material of the latter.

Figure 2:
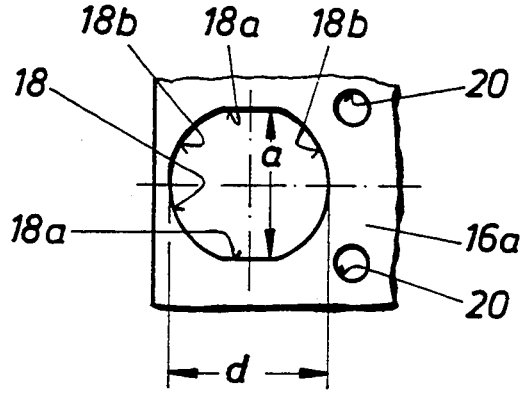
Figure 3:
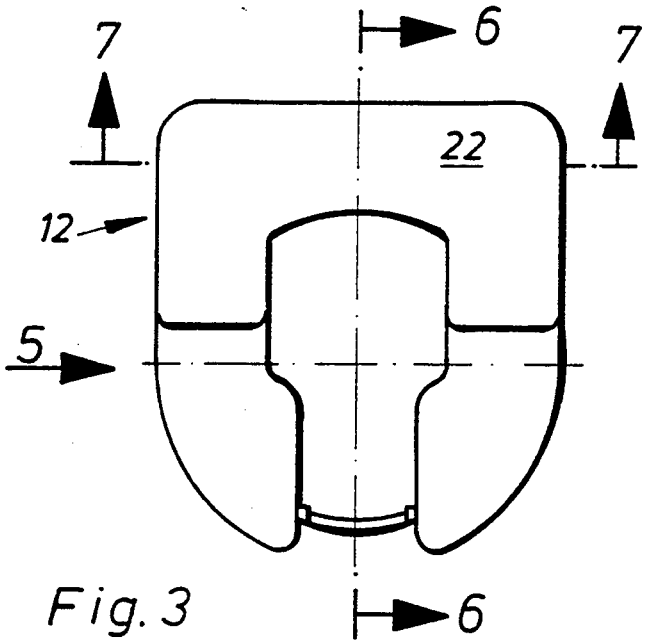
Figure 6:
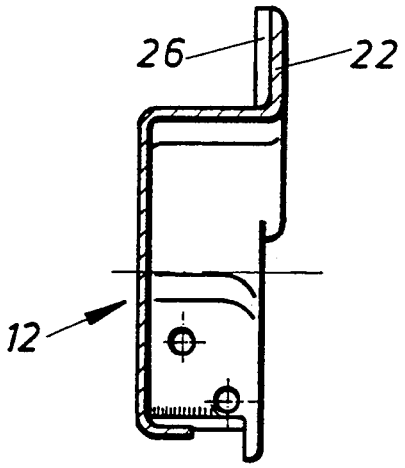
Figure 7:
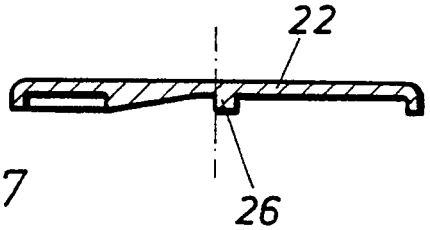
Figure 5:
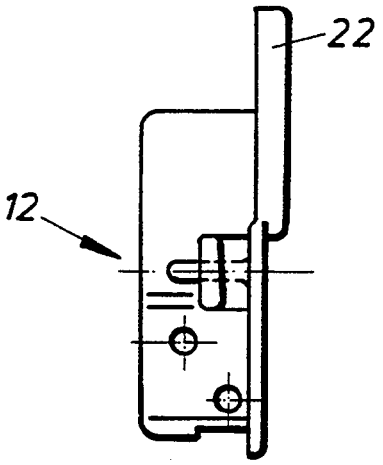
Figure 4:
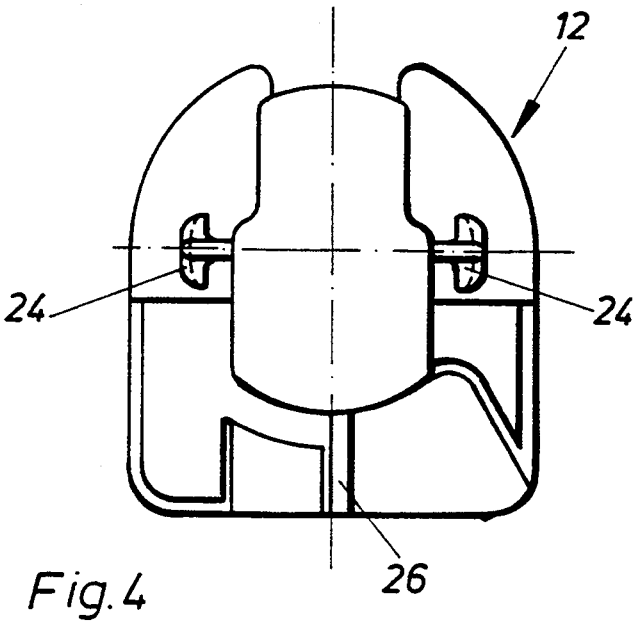
Figure 8:
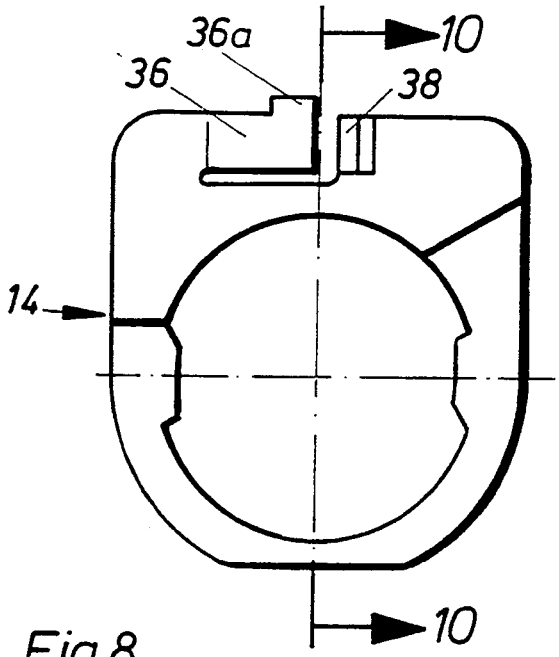
Figure 10:
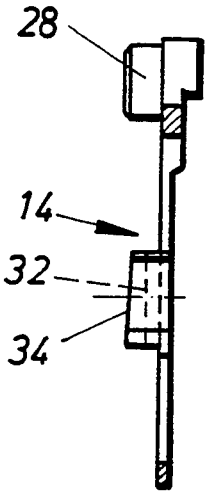
Figure 11:
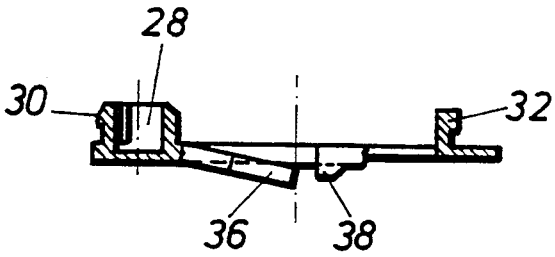
Figure 9:
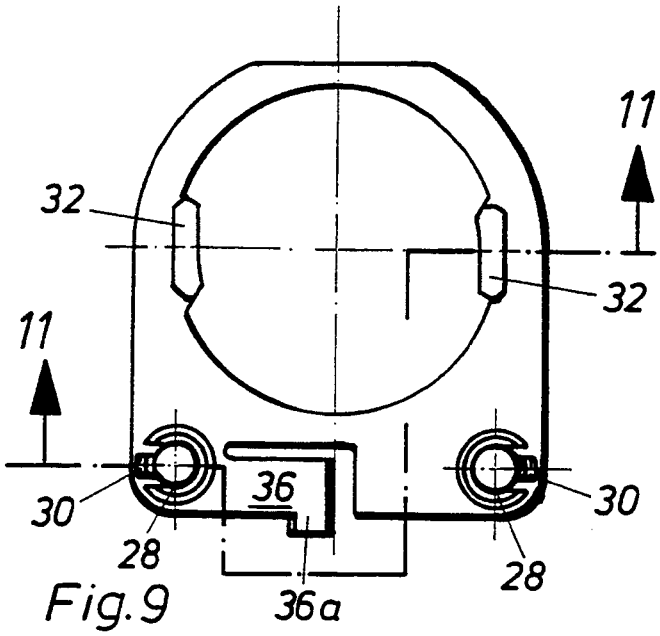

The invention is further explained in the following description of an embodiment in conjunction with the drawing, wherein:

FIG. 1 is a perspective view of a section of a double-walled door with a liner plate fastened to it and a cup part represented raised up from the liner plate, FIG. 2 is a top plan view on a reduced scale of the section of the section of the carcase-interior wall of the door, in which the shape and position of the openings punched to receive the hinge housing can be seen, FIG. 3 is a top plan view of the metal cup part of the hinge housing according to the invention, FIG. 4 is a bottom view of the cup part, FIG. 5 is a side view of the cup part seen in the direction of arrow 5 in FIG. 3, FIG. 6 is a sectional view seen in the direction of arrows 6—6 in FIG. 3, FIG. 7 is a sectional view through the fastening flange of the cup, seen in the direction of arrows 7—7 in FIG. 3, FIG. 8 is a top view of the liner plate of the hinge housing according to the invention, FIG. 9 is a bottom view of the liner plate shown in FIG. 8, FIG. 10 is a sectional view seen in the direction of the arrows 10—10 in FIG. 8, and FIG. 11 is a sectional view along the section line 11—11 in FIG. 9.

The hinge housing shown in FIG. 1, identified as a whole by 10, is composed of a fastening flange 12 made of metal and explained below in connection with FIGS. 3 to 7, and a liner plate 14 of plastic shown in detail in FIGS. 8 to 11. The hinge housing 10 forms the door-related member of an articulated hinge, not shown, and in this particular case a four-jointed hinge by means of which a door of sheet metal is hung on a cabinet. The hinge housing 10 is intended for recessed mounting in the marginal area 16 of a double-walled door; **16*a* identifies the wall that faces the interior of the cabinet when the door is closed, and 16*b* the outer wall, these walls being held at a given distance apart by the end wall 16*c* forming the lateral boundary of the door, so that a space exists between the walls 16*a* and 16*b***.

Openings represented in FIG. 2 are punched in the wall **16*a* for the installation of the hinge housing 10, namely an opening 18 which is circular over most of its circumference and punched in the immediate vicinity of the end wall 16*c* of the door and, at a greater distance from the end wall 16*c*, two circular holes 20 of lesser diameter. On two diametrically opposite sides, the opening 18 has a short, rectilinear section 18*a* at right angles to the adjacent edge of the door, at a distance 'a' apart from one another that is less than the diameter 'd' of the remaining arcuate sections 18*b* of the opening 18. The additional holes 20 of lesser diameter are located symmetrically on either side of the center line of opening 18** which is at right angles to the edge of the door.

To fasten the hinge housing 10 to the door 16, first the liner plate 14 is fastened in the openings 18 and 20, and then the fastening flange 12 can be releasably snap-fastened to the liner plate 14.

The fastening flange 12 made in the present case by pressure-casting from metal has at its upper rim of a cup portion, a flange portion 22 which, in the proper position on the door 16, overlaps the areas of the wall **16*a* adjoining the punched opening 18. The cup portion itself, as it can be seen especially in FIG. 4, is in the shape of a tub flattened on the sides, which is arcuately defined at its narrow ends as seen in plan; the diameter measured across the arcuate defining walls corresponds approximately to the diameter 'd'; measured between the circularly defined sections 18*b* of the opening 18. A locking projection 24 extends at a distance from the flange portion 22 from each of the lateral flattened walls of the cup portion, and the distance measured across the outer ends of the locking projections 24 also corresponds to the diameter 'd' of the opening 18. Thus it is possible to insert the cup portion into the opening 24 if the locking projections 24 are opposite the arcuate sections 18*b* of opening 18. If, after insertion, the cup portion is rotated to the proper installed position, the locking projections 24 are guided underneath the straight sections 18*a* of the opening 18 and in this position the hinge housing can no longer be pulled back out of the opening 18**.

From the underside of the flange portion 22 a low bar-shaped projection 26 extends, which is a part of a locking mechanism with the liner plate 14 disposed on the wall **16*a* under the flange portion 22. The outline of liner plate 14 matches the outline of the flange portion 22, so that when the hinge housing is properly installed it is completely covered over by the flange portion 22. In the areas opposite the additional openings 20 in the wall 16*a*, the liner plate has studs 28 whose diameter is substantially equal to the diameter of the punched openings 20, but at the lower end of a resilient wall section cut from the circumferential wall of the fastening studs a catch projection 30 is provided, and these catch projections snap open when the fastening studs 28 are pressed into the punched holes 20 as soon as the liner plate 14 lies flat against the wall 16*a*. An additional locking of the liner plate 14 takes place in the opening 18: the liner plate reaches through the opening 18 in the area of the straight lateral edges 18***a* and has on the flat sides of the wall 16*a* facing away from the carcase radially extending projections 32 which catch lockingly on the portions of the wall 16*a* adjoining the straight edges 18*a*. On their end face 34 opposite the actual liner plate the locking projections 32 have a ramp which together with a complementary ramp on the associated face of the locking projections 24 of the cup part 12 produces a pull tightening the cup part to the wall 16*a* when it is turned from the insertion position to the proper installed position, and then simultaneously the liner plate 14 is gripped between the fastening flange and the wall 16*a*. The liner plate side portion of the locking mechanism cooperating with the bar-like projection 26 of the flange portion 22 is formed by a resilient tongue 36 cut from the material of the liner plate, which is bent upward toward the flange portion and, when the fastening flange is installed, is forced by the projection 26 toward the wall 16, until the projection 26 passes over the free end of the tongue 36 and the latter then snaps behind the projection and locks the fastening flange 12 against turning back again. Any further turning of the fastening flange beyond the proper installed position is prevented by an abutment 38 protruding upward frown the liner plate. The tongue 36 has in the area of its free, springing end a lateral projection 36*a* which extends slightly beyond the margin of the flange portion. By pressing on this projection 36*a* the tongue can be forced from its position locking the projection 26, and then the fastening flange part 12 can be turned back again and removed.

I claim:

1. A hinge housing for installation in an opening in a thin sheet wall of a door, the hinge housing comprising:

(a) a liner plate for installation along an underside thereof against an inside face of the wall, the liner plate having an opening which generally conforms to the opening in the wall, the liner plate comprising at least two first locking projections extending from the underside of the plate which can grip an outside face of the wall upon rotation of the liner plate, and (b) a fastening flange for installation against the upper side of the liner plate, the fastening flange comprising a cup portion and a flange portion extending radially from a rim of the cup portion, the outside perimeter of the cup portion generally conforming to the opening in the wall, such that when the fastening flange is installed against the liner plate, the flange portion covers the liner plate and the cup portion extends into the opening and through the wall, the fastening flange further comprising at least two second locking projections extending from the underside of the flange portion, the second locking projections corresponding in number and arrangement with the first locking projections, the second locking projections being engageable with the first locking projections upon rotation of the fastening flange to forcibly retain the first locking projections against the outside face of the wall.

2. The hinge housing of claim 1, wherein the liner plate further comprises at least one fastening stud extending from the underside of the plate for press-fitting into an associated hole in the wall set apart from the opening in the wall.

3. The hinge housing of claim 2, wherein the fastening stud comprises at least one resilient catch projection for engaging the outside face of the wall.

4. The hinge housing of claim 1, wherein the first and second locking projections each having complementary inclined engagement surfaces such that when the fastening flange is rotated, the inclined surface of the second locking projections rides along the complementary inclined surface of the first locking projections to thrust the first locking projections against the outside face of the wall.

5. The hinge housing of claim 1, wherein the liner plate has at least one integral tongue resiliently rotatable in a direction away from the inside face of the wall, the tongue being rotatable about an axis coplanar with the liner plate and running approximately through the center of the opening in the liner plate, and wherein the fastening flange has a third locking projection extending from the underside of the flange portion and cooperating with the tongue so as to engage a free edge of the tongue to prevent rotation of the fastening flange in a reverse direction.

6. The hinge housing of claim 5, wherein the liner plate has an abutment opposite the free end of the tongue and cooperating therewith to engage the third projection so as to prevent continued rotation of the fastening flange.

7. The hinge housing of claim 5, wherein the tongue extends radially beyond the edge of the flange portion to form a tab for releasing the third projection from engagement with the tongue.

8. A hinge housing in combination with a door, (1) the door comprising at least one wall of thin sheet, the wall having an inside face and an outside face, and an opening therethrough for receiving the hinge housing, (2) the hinge housing comprising:

(a) a liner plate for installation along an underside thereof against the inside face of the wall, the liner plate having an opening which generally conforms to the opening in the wall, the liner plate comprising at least two first locking projections extending from the underside of the plate which grip the outside face of the wall upon rotation of the liner plate, and (b) a fastening flange for installation against the upper side of the liner plate, the fastening flange comprising a cup portion and a flange portion extending radially from a rim of the cup portion, the outside perimeter of the cup portion generally conforming to the opening in the wall, such that when the fastening flange is installed against the liner plate, the flange portion covers the liner plate and the cup portion extends into the opening and through the wall, the fastening flange further comprising at least two second locking projections extending from the underside of the flange portion, the second locking projections corresponding in number and arrangement with the first locking projections, the second locking projections being engageable with the first locking projections upon rotation of the fastening flange to forcibly retain the first locking projections against the outside face of the wall.

9. The combination of claim 8, wherein the door comprises the one wall and a second wall, and has a hollow space therebetween.

10. The combination of claim 8, wherein the opening in the wall is comprised of two diametrically opposite rectilinear sides, and two diametrically opposite arcuate sides, the distance between said two rectilinear sides being smaller than the shortest distance between said two arcuate sides, and wherein the cup portion has two flattened opposite sides and the second locking projections extend from the flange portion at a location adjacent the flattened sides so that upon installation the second projections are situated adjacent the rectilinear sides of the opening.

11. The combination of claim 10, wherein the first locking projections are located on the linear plate so as to reside against the outside face of the wall adjacent the rectilinear sections of the opening.

12. The combination of claim 8, wherein the wall has at least one hole set apart from the opening, and wherein the liner plate further comprises at least one fastening stud of diameter slightly greater than that of the hole, the stud extending from the underside of the plate for press-fitting into the hole.

13. The combination of claim 12, wherein the fastening stud comprises at least one resilient catch projection for engaging the outside face of the wall.

14. The combination of claim 8, wherein the first and second locking projections each have complementary inclined engagement surfaces such that when the fastening flange is rotated, the inclined surface of the second locking projections rides along the complementary inclined surface of the first locking projections to thrust the first locking projections against the outside face of the wall.

15. The combination of claim 8, wherein the liner plate has at least one integral tongue resiliently rotatable in a direction away from the inside face of the wall, the tongue being rotatable about an axis coplanar with the liner plate and running approximately through the center of the opening in the liner plate, and wherein the fastening flange has a third locking projection extending from the underside of the flange portion and cooperating with the tongue so as to engage a free edge of the tongue to prevent rotation of the fastening flange in a reverse direction.

16. The combination of claim 15, wherein the liner plate has an abutment opposite the free end of the tongue and cooperating therewith to engage the third projection so as to prevent continued rotation of the fastening flange.

17. The combination of claim 15, wherein the tongue extends radially beyond the edge of the flange portion to form a tab for releasing the third projection from engagement with the tongue.

* * * * *